United States Patent [19]

Burkholder et al.

[11] Patent Number: 4,703,562

[45] Date of Patent: Nov. 3, 1987

[54] PENDULUM DESIGN MACHINE

[76] Inventors: Dennis H. Burkholder, P.O. Box 658, Rolla, N. Dak. 58367; Douglas M. Bonsness, 1003 Harrison Dr., Minot, N. Dak. 58701

[21] Appl. No.: 927,813

[22] Filed: Nov. 6, 1986

[51] Int. Cl.[4] ..... B43L 11/06; B43L 9/20

[52] U.S. Cl. ..... 33/27.11

[58] Field of Search ..... 33/27.11

[56] References Cited

U.S. PATENT DOCUMENTS

| | | | |
|---|---|---|---|
| 1,869,951 | 8/1932 | Worthington | 33/27.11 |
| 3,143,807 | 4/1964 | Christie | 33/27.11 |
| 3,324,556 | 6/1967 | Everett | 33/27.11 |
| 3,494,037 | 2/1970 | Arber | 33/27.11 |
| 3,977,085 | 8/1976 | Sandifer | 33/27.11 |
| 4,162,577 | 7/1979 | Cosman | 33/27.11 |
| 4,199,867 | 4/1980 | Cass | 33/27.11 |

OTHER PUBLICATIONS

Description of a pendulum design machine which was in existence approximately 35 years ago.

*Primary Examiner*—Harry N. Haroian
*Attorney, Agent, or Firm*—Merchant, Gould, Smith Edell, Welter & Schmidt

[57] ABSTRACT

A drawing device (1), utilizing a first pendulum (2) and a second pendulum (3), wherein a relatively frictionless ball (67) and socket (68) joint transfers the resultant motion of the pendulums to a writing instrument (75). A deformable gripping element (22) permits rapid attachment and removal of pendulum weights (17 and 28) from their respective vertical support arms (4 and 14).

10 Claims, 8 Drawing Figures

PENDULUM DESIGN MACHINE

BACKGROUND OF THE INVENTION

1. Field of the Invention

The field of the invention is that of toys incorporating drawing devices. The particular nature of the invention is an automatic device for drawing patterns, based on the movement of two interacting pendulums.

2. Description of Related Technology

Devices intended to produce various designs and including two pendulums mounted to swing relative to each other are known. These instruments produce intricate and fanciful line configurations and designs by employing two pendulums coupled with an inscribing or drawing tool. The motion of each pendulum is superimposed simultaneously upon the tool so that the ultimate movement of the tool is the resultant of the individual pendulum movements. The various structural parts or elements of the instrument are so oriented that the inscribing tool can be caused to trace the design or configuration on a sheet of paper or plastic corresponding to its path of movement. However, due to the periodic but decreasing motion of the pendulums, the basic pattern traced will remain the same but will decrease in magnitude, providing a symmetrical and attractive design. Thus, since the resultant movement of the inscribing instrument is a function of the period or timing of the pendulum swing, an infinite number of patterns may be achieved by adjusting the relative position of the respective pendulum weights, which in turn changes the pendulum period.

For example, U.S. Pat. No. 3,143,807, issued to Christie, discloses a pendulum drawing device which includes a pair of pendulums that are supported with respect to a drawing surface. The upper portions of the pendulum arms are connected to a writing instrument by a pair of wires 4. Tension is created on the wires by a counter weight 6. Weights are located at the lower ends of the pendulum arms. The longitudinal position of the weights may be adjusted to alter the motion of the pendulums. The pendulums are pivoted so as to create a design on a paper sheet.

U.S. Pat. No. 3,324,556, issued to Everett, discloses a pair of pendulums which are supported with respect to a platform. The pendulums are interconnected by a pair of arms which carry a writing instrument. The pendulums each carry a weight which may be adjusted longitudinally. The pendulums are pivoted so as to create a design with the writing instrument.

U.S. Pat. No. 3,494,037, issued to Arber, discloses a pair of pendulums supported with respect to a writing surface. A pair of arms are connected to the upper ends of the pendulums and to a writing instrument. A unique aspect of this disclosure is the weight, which may be filled with water in varying amounts, thereby changing the mass of the pendulum bob. A spring-type locking mechanism is used to support the pendulums with respect to the writing surface.

U.S. Pat. No. 3,977,085, issued to Sandifer, discloses a pendulum toy which may be used for drawing unique designs. This device has a secondary weighting system which counterbalances the weight placed on the pen. The pendulums also have a curved portion 46 which permits the pendulum to be mounted on a table surface without requiring a slot in the table surface.

U.S. Pat. No. 4,162,577, issued to Cosman, discloses a pendulum drawing machine including a pair of vertically oriented pendulum arms interconnected to a writing instrument, such as a pen, by a pair of arms 9 and 10. The arms include resilient portions at their interconnecting point with the pendulums. Also, a flexible connection is provided adjacent to the pen holder. This connection may be a flexible rectangular sheet material.

U.S. Pat. No. 4,199,867, issued to Cass, discloses a device for drawing unique designs in which the writing surface is supported by a plurality of flexible cords while the pen is held in a stationary position. Thus, the writing surface itself imitates the movement of a pendulum swinging back and forth so as to create unique designs.

Each of the disclosures discussed above are rather cumbersome and are capable of producing only a limited range of designs. Their motion also tends to dampen rather quickly and to transfer unwanted vibrations to the writing instrument. Also, the weights on the pendulums must be of a relatively large mass.

The present invention addresses the problems posed by prior art devices by creating a portable, lightweight device (typically constructed of plastic) that is self-contained, compact and easily assembled. A universal pen holder accepts most kinds of ball point pens and other writing instruments. The use of a control post at the junction of the members transferring the pendulum movement, and the use of ball and socket joints at the tip of the pendulum and end of the force transferring members, greatly improves peformance and control of the apparatus.

SUMMARY OF THE INVENTION

The present invention is a device which is used to draw intricate designs using a pair of swinging pendulums to drive a pen. The pendulum includes an upstanding arm portion comprising two arm sections. The lower arm section supports a weight. The upper arm portion has a plurality of openings through which a pivot axis may be inserted.

The device also includes a horizontal arm section which is connected to the upper end of the pendulum arm, such as by a ball and socket. The horizontal arm may carry a clamp for securing a pen. A second pendulum assembly makes up the device and is similarly constructed with a vertical arm, including a weight and a plurality of openings through which a pivot axis may be selectively inserted. The two horizontal arms are connected at adjacent ends, such as by a ball and socket arrangement. The arms are suitably supported on a platform which carries a pivot axis, thereby transferring the resultant periodic motion of the two pendulums to a single writing instrument.

DETAILED DESCRIPTION OF THE PREFERRED EMBODIMENT

Figure 1:
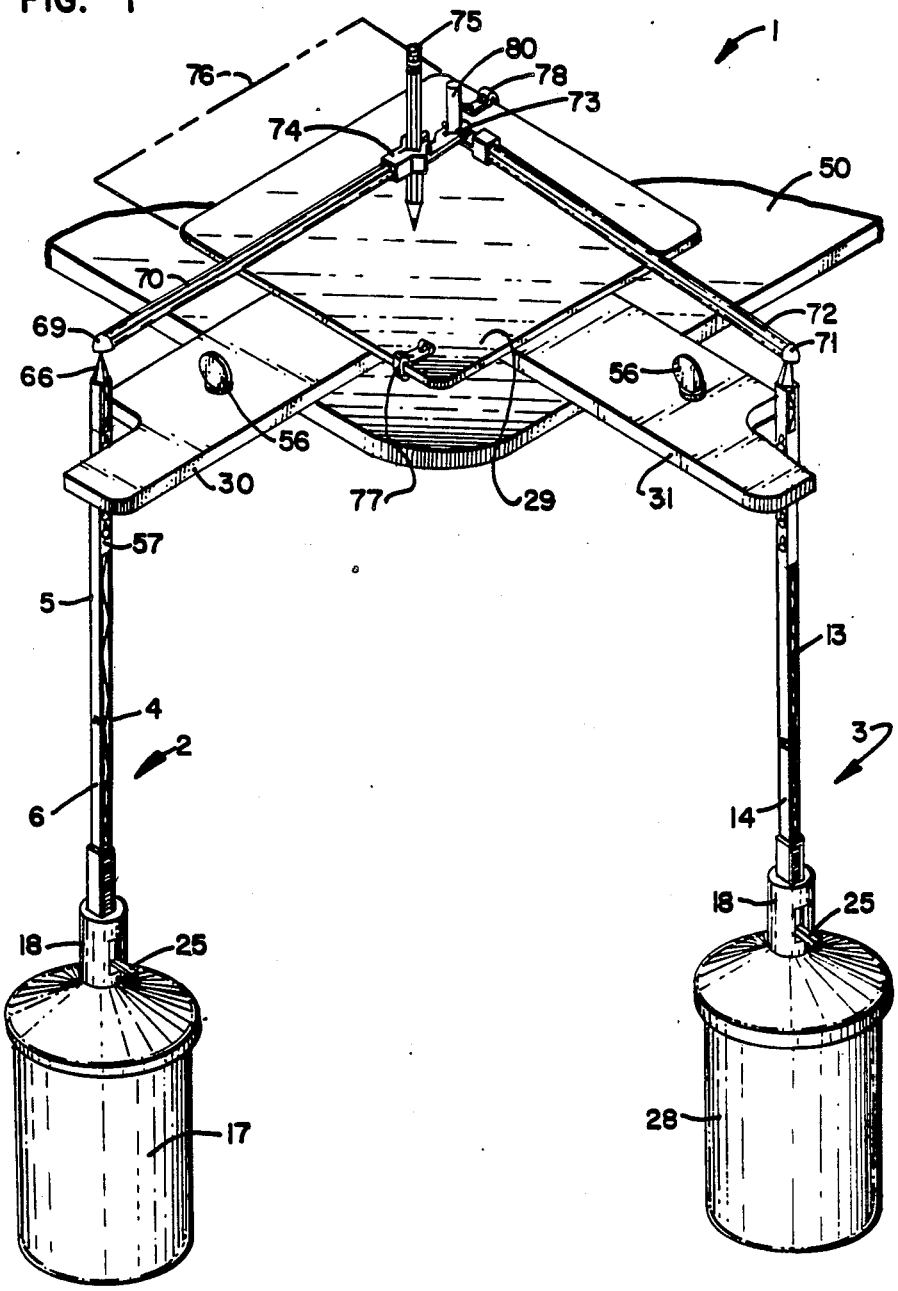
FIG. 1 is a perspective view of a device constructed according to the present invention.

Referring to FIG. 1, a device constructed according to the present invention is shown generally at 1. The device comprises a first pendulum 2 and a second pendulum 3. Pendulums 2 and 3 are substantially identical, their relative positions being interchangeable when employed in conjunction with the remainder of device 1. First pendulum 2 comprises a vertical arm 4 which includes an upper arm portion 5 and a lower arm portion 6.

Figure 3:
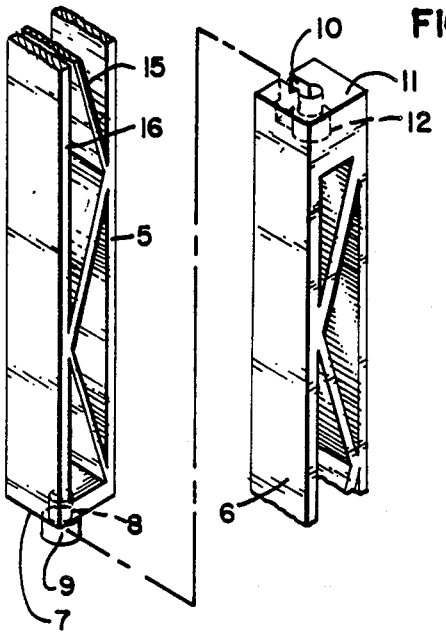
FIG. 3 is an expanded perspective view of a portion of individual segments forming the pendulum arms as depicted on the device shown in FIG. 1.

As best viewed in FIG. 3, the lower end 7 of upper arm portion 5 is generally rectangular in planform, and contains a centrally located protruding post 8. The head 9 of post 8 is formed substantially as a cylinder having a diameter greater than that of post 8. A compatibly shaped notch 10 is formed within the top end 11 of lower arm portion 6, the notch 10 leading to chamber 12 which is adapted to receive post 8 and head 9, thereby securing upper arm portion 5 to lower arm portion 6. A similar arrangement is used to fasten upper arm portion 13 to lower arm portion 14 of second pendulum 3. Note that in order to create a rigid vertical arm 4, while minimizing weight and its associated inertial effects, the vertical arm 4 is constructed using diagonal truss elements 15 which support side walls 16.

In order to sustain the oscillatory motion of first pendulum vertical arm 4, a weight 17 is attached to the bottom end 19 of lower arm portion 6. Centrally located on the upper surface of weight 17 is a housing 18, into which fits the bottom end 19 of lower arm portion 6.

Figure 5:
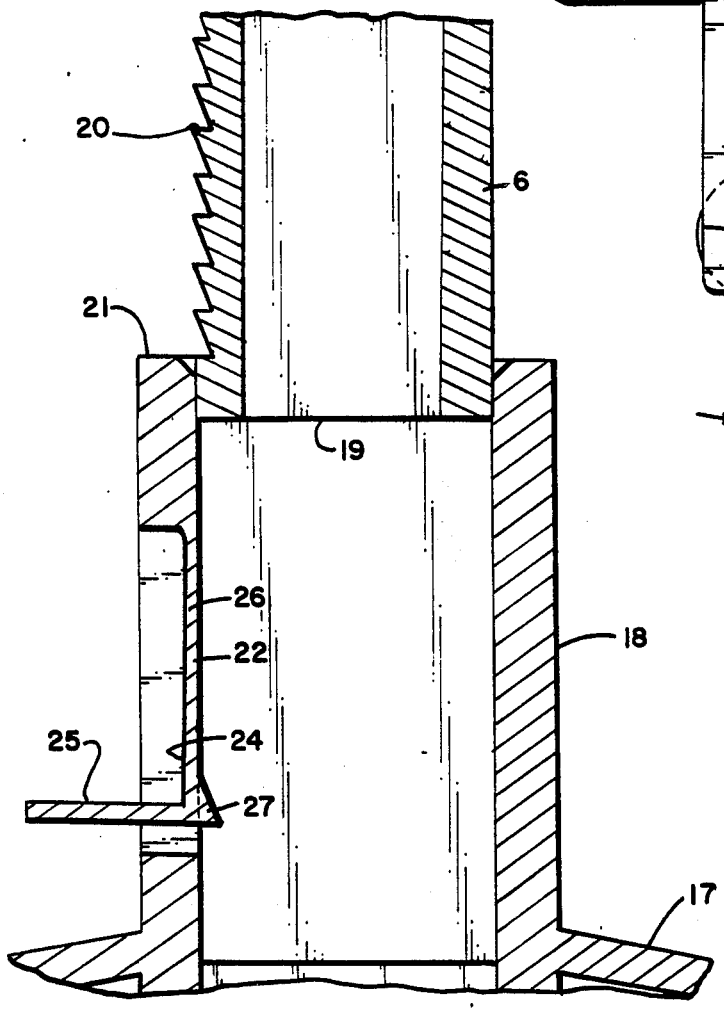
FIG. 5 is a sectional elevation of a portion of the device shown in FIG. 1, depicting the manner in which the weights are supported by and affixed to the pendulum arms.
Figure 7:
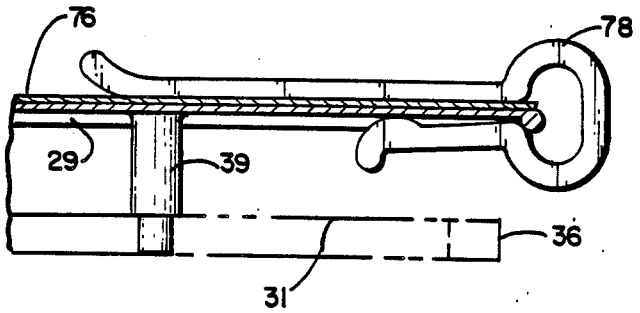
FIG. 7 is a sectional elevation showing the paper support platform of the device of FIG. 1.

One novel aspect of the present invention resides in the method of attachment of weight 17 to lower arm portion 6, as can best be seen in FIG. 5. On one side of the surface of lower arm portion 6 are formed a series of serrations 20. Affixed to the top edge 21 of housing 18 is gripping member 22. Gripping member 22 is flexibly attached to edge 21 by means of hinge 23, the hinge being made possible by virtue of the fact that gripping member 22 and housing 18 are integrally formed of a flexible material, such as plastic. Affixed to the outer surface 24 of gripping member 22 is hook 25, while along a portion of the inner surface 26 of gripping member 22 are formed a series of serrations 27. In order to attach weight 17 to lower arm portion 6, one must simply insert end 19 into housing 18, the serrations 20 and 27 thereby interlocking so as to securely grip lower arm portion 6 within housing 18. Of course various other mechanisms can be used to adjustably secure weight 17 to the lower arm portion 6, for example, a pin may be inserted through cooperating openings weight 17 and arm portion 6.

In order to remove the weight 17 from vertical arm portion 4, one need only pull slightly on hook 25, thereby deforming gripping member 22 sufficiently to release the engagement of serrations 27 and 20. The construction of second pendulum 3 ad its method of attachment to weight 28 is substantially identical to that just described for first pendulum 2.

Figure 2:
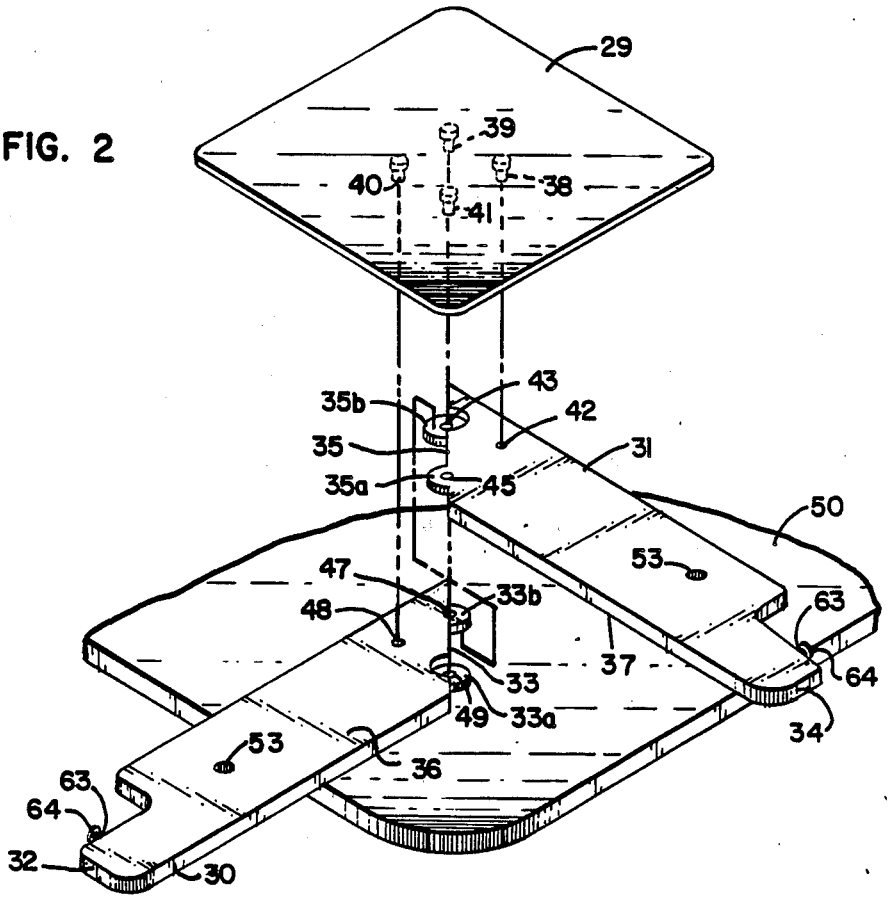
FIG. 2 is an expanded perspective view of the pendulum support sub-assembly of the device shown in FIG. 1.

Other general features of the device 1 may now be best described by reference to FIGS. 1 and 2. The device 1 comprises a horizontal platform 29, which is generally rectangular in shape and which may be constructed of any thin, rigid, non-warping material, such as many types of plastic. Attached to the bottom surface of platform 29 is a first horizontal support arm 30 and a second horizontal support arm 31. Both horizontal support arms are substantially identical, although their respective orientations are somewhat different when installed on platform 29. The first horizontal arm 30 has a notched end 32 and an oppositely disposed, perforated end 33. Similarly, horizontal support arm 31 has a notched end 34 and an oppositely disposed notched end 35. Referring particularly to FIG. 2, note that while first horizontal support arm 30 and second horizontal support arm 31 are substantially identical, the upper surface 36 of first horizontal support arm 30 corresponds to lower surface 37 of second horizontal support arm 31.

The ends 33*a*, 33*b* and 35*a*, 35*b* of the respective horizontal support arms have a thickness of approximately one half the thickness of the remainder of the horizontal support arms. Thus, when the two notched ends 33*a*, 33*b* and 35*a*, 35*b* are placed one on top of the other at right angles as shown in FIG. 2, the resulting assembly has a thickness approximately equal to that of notched ends 32 and 34 of the respective horizontal support arms.

Horizontal platform 29 contains four centrally disposed mounting posts 38, 39, 40 and 41. In order to rigidly affix platform 29 to horizontal arms 30 and 31, the four posts are inserted through corresponding orifices 42, 43, 44 and 45 of second horizontal support arm 31, and then through corresponding mounting holes 46, 47, 48 and 49 in horizontal support arm 30.

Figure 8:
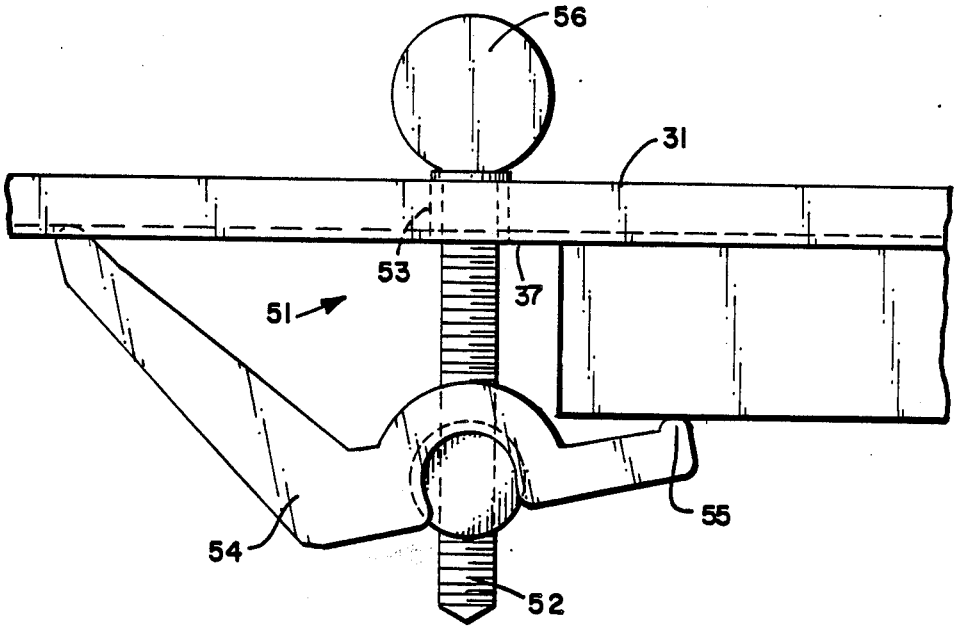
FIG. 8 is a sectional elevation of a portion of the device shown in FIG. 1, depicting the manner in which the device is affixed to a horizontal support surface.

In operation, the device 1 should be mounted to a suitable horizontal surface, such as table top 50. Mounting is accomplished by means of clamp assembly 51, as shown in FIG. 8. Clamp assembly 51 comprises a threaded shaft 52 which passes through orifice 53 of second horizontal support arm 31. Shaft 52 engages angle bracket 54, the angle bracket having a rounded end 55 so as to permit engagement of surfaces without marring. By rotating the head 56 of shaft 52, the angle bracket 54 is urged upwardly toward head 56. Thus, by inserting table surface 50 between the lower surface 37 of second horizontal support arm 31, and rounded end 55 of angle bracket 54, knob 56 may be rotated, thereby gripping table top 50 between angle bracket 54 and second horizontal support arm 31. A substantially identical clamp assembly is affixed to first horizontal support arm 30.

Figure 4:
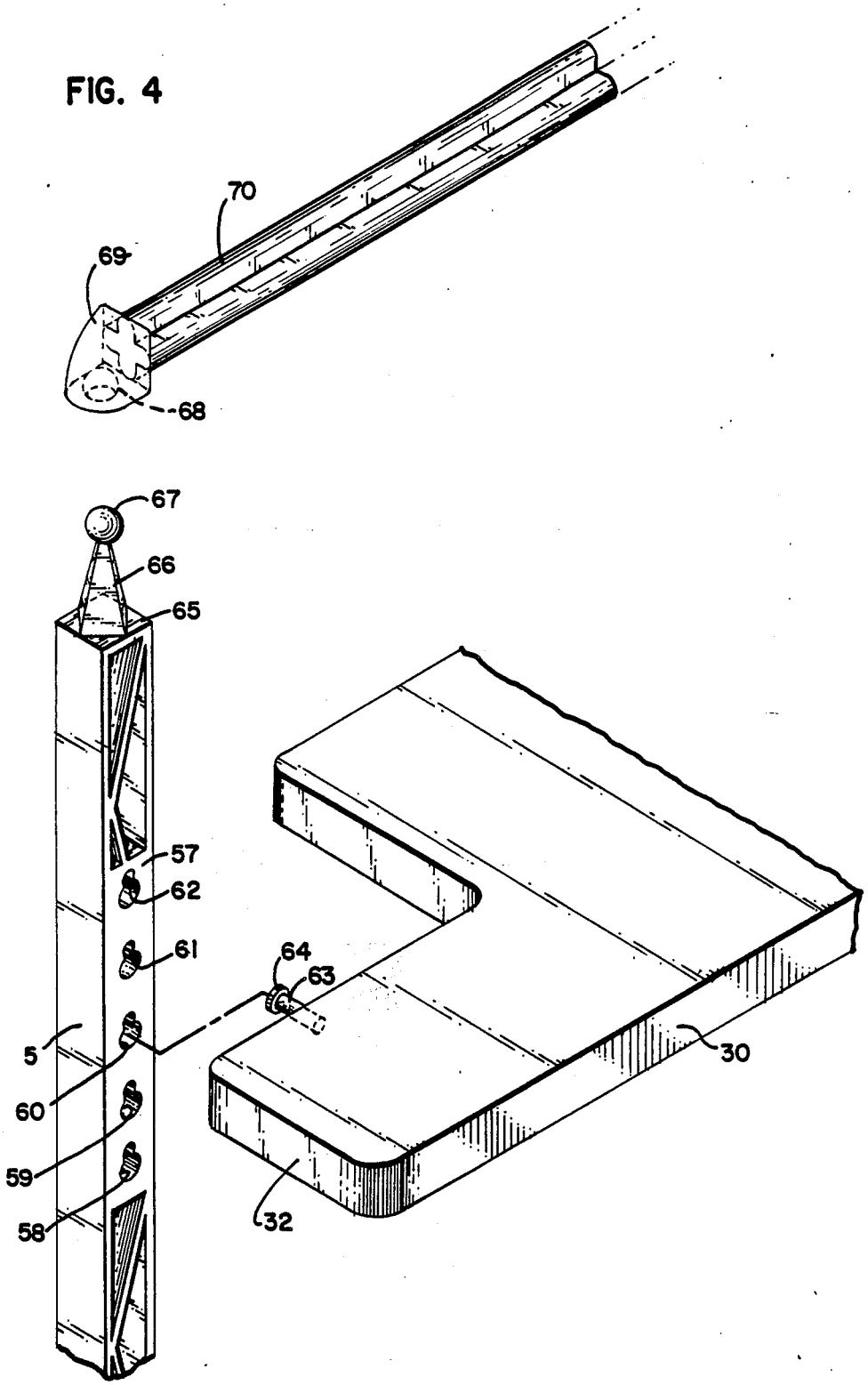
FIG. 4 is an expanded perspective view of a portion of the device shown in FIG. 1, depicting the relationship of parts comprising the pendulum arm, horizontal force transferring members, and the rigid support subassembly.

Referring now particularly to FIGS. 1 and 4, the mounting and adjustment of the pendulums 3 and 4, when operating as part of device 1, will now be described. As seen in FIG. 4, the upper region 57 of upper support arm 5 includes a vertically spaced series of elongated passageways, identified by reference numbers 58, 59, 60, 61 and 62, with passageway 58 representing the lowest passageway while passageway 62 refers to the uppermost passageway. A post 63 having an enlarged head 64 is mounted horizontally within notched end portion 32 of first horizontal support arm 30. Each of the elongated passageways, reference numerals 58 through 62, is compatibly shaped to permit insertion of post 63 within the individual passageways, head 64 serving to retain upper arm 5 on post 63. The diameter of post 63 is such as to permit freely pivoting motion about post 63 by upper arm portion 5 when mounted in any of the elongated passageway 58 through 62.

Affxed to the top end 65 of upper arm portion 5 is a pedestal 66, the pedestal being shaped generally as a polyhedron. At the top of polyhedron 66 is spherical bearing 67. Bearing 67 is compatibly sized so as to fit within socket 68, the socket residing within end 69 of first horizontal arm 70. The bearing 67 and socket 68 form a freely pivoting joint having multiple degrees of freedom, thereby permitting the motion of pendulum 2 to be readily and accurately transferred through horizontal member 70 to writing instrument 75. A substantially identical ball and socket arrangement is mounted at end 71 of second horizontal arm 72, the second horizontal arm 72 being interconnected with second pendulum 3.

Figure 6:
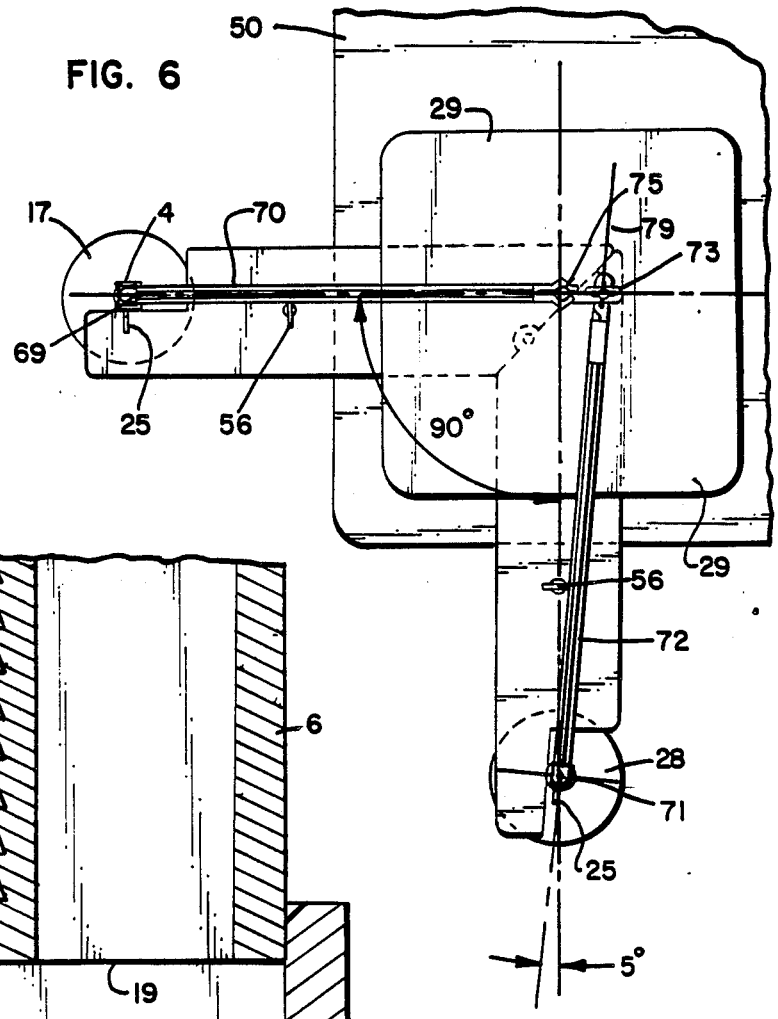
FIG. 6 is a plan view of the device shown in FIG. 1.

Referring now to FIGS. 1 and 6, the interactive effect of first horizontal arm 70 and second horizontal arm 72 may be described. Near the end 73 of first horizontal arm 70 is mounted a writing instrument holder 74 which is adaptable for holding a wide variety of writing instruments such as pencil 75. The holder 74 causes pencil 75 to be gripped securely in a position perpendicular to the plane of horizontal surface 29. A piece of paper 76 or other suitable material is placed on horizontal surface 29, the paper 76 being held in place by clips 77 and 78.

End 73 of first horizontal member 70 and end 79 of second horizontal member 72 are placed in an adjacent, stacked relationship, being interconnected by control post 80 which passes through a suitable mounting hole machined perpendicularly through ends 73 and 79. The diameter of control post 80 is so dimensioned as to permit the free rotation about control post 80 of both first horizontal arm 70 and second horizontal arm 72, a small transverse pin 81 retaining control post 80 in place and preventing its contact with the surface of paper 76.

As can be seen in FIGS. 1 and 6, any motion imparted by pendulums 2 and 3 to horizontal arms 70 and 72 will be mechanically transferred through the joint defined by post control 80, the resultant force causing pencil 75 to trace a path on the surface of paper 76. Since pendulums 2 and 3 are confined to movement in a single plane, their movement defines a regular oscillatory motion characteristic of a pendulum. Thus, once the pendulums are set in motion, regardless of the magnitude of their individual movements, the resultant motion will be a regular, cyclical movement which will be traced by writing instrument 75.

The foregoing disclosure is a representative form of the invention and is to be interpreted in an illustrative rather than a limiting sense, the invention to be accorded the full scope of the claims appended hereto.

I claim:

1. A device for drawing patterns, comprising:

(a) means defining a horizontal planar surface, the planar surface being adapted to support a sheet on which the patterns may be drawn;

(b) a first horizontal member, the first horizontal member having a first end and an oppositely disposed second end;

(c) a second horizontal member, the second horizontal member having a first end and an oppositely disposed second end;

(d) a control post interconnecting the first end of the first horizontal member and the first end of the second horizontal member such that the first and second horizontal members may pivot freely and independently about the control post on a plane substantially parallel to the horizontal planar surface;

(e) a first horizontal support arm, the first horizontal support arm being rigidly affixed in a stacked, coplanar relationship, to the horizontal planar surface, the first horizontal support arm having an outer end region and an inner region;

(f) a second horizontal support arm, the second horizontal support arm being rigidly affixed, in a stacked, coplanar relationship, to the horizontal planar surface and an inner region, wherein the inner regions of said first and second horizontal support arms underlie and support said horizontal planar surface means;

(g) a first pendulum, the first pendulum having a first end, an upper region and a second end, the first pendulum being pivotably attached at the upper region to the first horizontal support arm, the first end of the first pendulum being pivotably attached to the second end of the first horizontal member such that the movement of the first pendulum is transferred to the first horizontal support member;

(h) a second pendulum, the second pendulum having a first end, an upper region and a second end, the second pendulum being pivotably attached at the upper region to the second horizontal support arm, the first end of the second pendulum being pivotably attached to the second end of the second horizontal member such that movement of the second pendulum is transferred to the second horizontal member; and (i) a writing instrument, the writing instrument being rigidly affixed to the first horizontal member such that the writing instrument draws a line along a path determined by a resultant motion generated by movement of the first horizontal member and the second horizontal member.

2. The drawing device of claim 1, wherein the first pendulum comprises:

(a) a relatively massive weight, the weight serving to sustain any motion of the pendulum;

(b) an upper arm portion, the upper arm portion being formed generally as a hollow rectangular solid having exterior side walls, the exterior side walls being supported by an internal truss, the internal truss being integrally formed within the upper arm portion;

(c) a separate lower arm portion, the lower arm portion being formed generally as a hollow rectangular solid having exterior side walls, the exterior side walls being supported by an internal truss, the internal truss being integrally formed within the lower arm portion, said lower arm portion being removably attached to the upper arm portion;

(d) means for attaching the upper arm portion to the lower arm portion, thereby forming a single vertical pendulum support arm; and (e) means for attaching the weight to the vertical pendulum support arm.

3. The drawing device of claim 2, wherein:

(a) the upper arm portion comprises a top end, a bottom end and (a longitudinal axis;) and (b) the lower arm portion comprises a top end, a bottom end and (a longitudinal axis.)

4. A device for drawing patterns, comprising:

(a) means defining a horizontal planar surface, the planar surface being adapted to support a sheet on which the patterns may be drawn;

(b) a first horizontal member, the first horizontal member having a first end and an oppositely disposed second end;

(c) a second horizontal member, the second horizontal member having a first end and an oppositely disposed second end;

(d) a control post interconnecting the first end of the first horizontal member and the first end of the second horizontal member such that the first and second horizontal members may pivot freely and independently about the control post in a plane substantially parallel to the horizontal planar surface;

(e) a first horizontal support arm, the first horizontal support arm being rigidly affixed in a stacked, coplanar relationship, to the horizontal planar surface, the first horizontal support arm having an outer end region;

(f) a second horizontal support arm, the second horizontal support arm being rigidly affixed, in a stacked, coplanar relationship, to the horizontal planar surface;

(g) a first pendulum, the first pendulum having a first end, an upper region and a second end, the first pendulum being pivotably attached at the upper region to the first horizontal support arm, the first end of the first pendulum being pivotably attached to the second end of the first horizontal member such that the movement of the first pendulum is transferred to the first horizontal support member, said pendulum further including an upper arm portion, the upper arm portion being formed generally as a hollow rectangular solid having exterior side walls, the exterior side walls being supported by an internal truss, the internal truss being integrally formed within the upper arm portion, a lower arm portion, the lower arm portion being formed generally as a hollow rectangular solid having exterior side walls, the exterior side walls being supported by an internal truss, the internal truss being integrally formed within the lower arm portion, means for attaching the upper arm portion to the lower arm portion, thereby forming a single vertical pendulum support arm, a relatively massive weight, the weight serving to sustain any motion of the pendulum, means for attaching the weight to the vertical pendulum support arm, the upper arm portion comprising a top end, a bottom end and a longitudinal axis, the lower arm portion comprising a top end, a bottom end and a longitudinal axis, an attachment post, the attachment post being substantially cylindrical in shape and having a base, the base having a first diameter, the post having a head, the head having a second diameter larger than the first diameter of the base of the post, the base of the post being integrally formed as a part of the bottom end of the upper arm portion such that the post is aligned with the longitudinal axis of the upper arm portion, and a notch, the notch being integrally formed within the top end of the lower arm portion, the notch being compatibly shaped so as to rigidly mate with the attachment post of the upper arm portion, the upper arm portion and the lower arm portion thereby being longitudinally aligned;

(h) a second pendulum, the second pendulum having a first end, an upper region and a second end, the second pendulum being pivotably attached at the upper region to the second horizontal support arm, the first end of the second pendulum being pivotably attached to the second end of the second horizontal member such that movement of the second pendulum is transferred to the second horizontal member; and (i) a writing instrument, the writing instrument being rigidly affixed to the first horizontal member such that the writing instrument draws a line along a path determined by a resultant motion generated by movement of the first horizontal member and the second horizontal member.

5. A device for drawing patterns, comprising:

(a) means defining a horizontal planar surface, the planar surface being adapted to support a sheet on which the patterns may be drawn;

(b) a first horizontal member, the first horizontal member having a first end and an oppositely disposed second end;

(c) a second horizontal member, the second horizontal member having a first end and an oppositely disposed second end;

(d) a control post interconnecting the first end of the first horizontal member and the first end of the second horizontal member such that the first and second horizontal members may pivot freely and independently about the control post in a plane substantially parallel to the horizontal planar surface;

(e) a first horizontal support arm, the first horizontal support arm being rigidly affixed in a stacked, coplanar relationship, to the horizontal planar surface, the first horizontal support arm having an outer end region;

(f) a second horizontal support arm, the second horizontal support arm being rigidly affixed, in a stacked, coplanar relationship, to the horizontal planar surface;

(g) a first pendulum, the first pendulum having a first end, an upper region and a second end, the first pendulum being pivotably attached at the upper region to the first horizontal support arm, the first end of the first pendulum being pivotably attached to the second end of the first horizontal member such that the movement of the first pendulum is transferred to the first horizontal support member, said pendulum further including an upper arm portion, the upper arm portion being formed generally as a hollow rectangular solid having exterior side walls, the exterior side walls being supported by an internal truss, the internal truss being integrally formed within the upper arm portion, a lower arm portion, the lower arm portion being formed generally as a hollow rectangular solid having exterior side walls, the exterior side walls being supported by an internal truss, the internal truss being integrally formed within the lower arm portion, means for attaching the upper arm portion to the lower arm portion, thereby forming a single vertical pendulum support arm, a relatively massive weight, the weight serving to sustain any motion of the pendulum, means for attaching the weight to the vertical pendulum support arm comprising a housing, the housing being integrally formed as a portion of the weight, the housing being substantially rectangular in plan form, the housing having a first side wall, the first side wall containing a substantially rectangular perforation, a first serrated side wall, the first serrated side wall being formed adjacent to the bottom end of the lower arm portion and a gripping member, the gripping member being formed integrally with the housing, the gripping member being compatibly formed so as to grip the first serrated side wall when the bottom end of the lower arm portion is inserted into the housing, thereby securing the weight to the vertical pendulum support arm, the upper arm portion comprising a top end, a bottom end and a longitudinal axis, the lower arm portion comprising a top end, a bottom end and a longitudinal axis.

(h) a second pendulum, the second pendulum having a first end, an upper region and a second end, the second pendulum being pivotably attached at the upper region to the second horizontal support arm, the first end of the second pendulum being pivotably attached to the second end of the second horizontal member such that movement of the second pendulum is transferred to the second horizontal member; and (i) a writing instrument, the writing instrument being rigidly affixed to the first horizontal member such that the writing instrument draws a line along a path determined by a resultant motion generated by movement of the first horizontal member and the second horizontal member.

6. The drawing device of claim 5, wherein the gripping member comprises:

(a) a planar portion, the planar portion having a top end, a midsection, a bottom section and an inner surface, the planar portion being composed of a deformable, resilient material;

(b) a serrated segment, the serrated segment being formed integrally with the inner surface adjacent to the bottom section of the planar portion, the serrated segment being adapted to mate with the first serrated side wall of the lower arm portion;

(c) a hinge, the hinge being integrally formed between the first side wall of the housing and the planar portion of the gripping member; and (d) a hook, the hook being integrally formed adjacent to the midsection of the planar member, the hook being formed substantially perpendicular to the planar member such that the hook extends through the substantially rectangular perforation in the first side wall of the housing, such that by pulling the hook, the planar portion is deformed so as to permit demating of the serrated segment and the first serrated side wall.

7. A device for drawing patterns, comprising:

(a) means defining a horizontal planar surface, the planar surface being adapted to support a sheet on which the patterns may be drawn;

(b) a first horizontal member, the first horizontal member having a first end and an oppositely disposed second end;

(c) a second horizontal member, the second horizontal member having a first end and an oppositely disposed second end;

(d) a control post interconnecting the first end of the first horizontal member and the first end of the second horizontal member such that the first and second horizontal members may pivot freely and independently about the control post in a plane substantially parallel to the horizontal planar surface;

(e) a first horizontal support arm, the first horizontal support arm being rigidly affixed in a stacked, coplanar relationship, to the horizontal planar surface, the first horizontal support arm having an outer end region;

(f) a second horizontal support arm, the second horizontal support arm being rigidly affixed, in a stacked, coplanar relationship, to the horizontal planar surface;

(g) a first pendulum, the first pendulum having a first end, an upper region and a second end, the first pendulum being pivotably attached at the upper region to the first horizontal support arm, the first end of the first pendulum being pivotably attached to the second end of the first horizontal member such that the movement of the first pendulum is transferred to the first horizontal support member, said pendulum further including an upper arm portion, the upper arm portion being formed generally as a hollow rectangular solid having exterior side walls, the exterior side walls being supported by an internal truss, the internal truss being integrally formed within the upper arm portion, a lower arm portion, the lower arm portion being formed generally as a hollow rectangular solid having exterior side walls, the exterior side walls being supported by an internal truss, the internal truss being integrally formed within the lower arm portion, means for attaching the upper arm portion to the lower arm portion, thereby forming a single vertical pendulum support arm, a relatively massive weight, the weight serving to sustain any motion of the pendulum, means for attaching the weight to the vertical pendulum support arm, the upper region of the first pendulum being formed with an exterior surface, the exterior surface being perforated by a series of longitudinally spaced, elongated passageways and the outer end region of the first horizontal support arm containing a pivot post, the pivot post having an enlarged head, the enlarged head being suitably dimensioned so as to be insertable into any of the elongated passageways, thereby permitting the pendulum to freely pivot about the pivot post;

(h) a second pendulum, the second pendulum having a first end, an upper region and a second end, the second pendulum being pivotably attached at the upper region to the second horizontal support arm, the first end of the second pendulum being pivotably attached to the second end of the second horizontal member such that movement of the second pendulum is transferred to the second horizontal member; and (i) a writing instrument, the writing instrument being rigidly affixed to the first horizontal member such that the writing instrument draws a line along a path determined by a resultant motion generated by movement of the first horizontal member and the second horizontal member.

8. The drawing device of claim 7, further comprising:

(a) an upper arm portion, the upper arm portion being formed as a polyhedron, the polyhedron having a top end;

(b) a sphere, the sphere being integrally formed as part of the top end of the polyhedron; and (c) a socket, the socket being formed in the second end of the first horizontal support member, the socket being adapted to receive the sphere, thereby creating a pivotable, relatively frictionless joint between the first pendulum and the first horizontal support member.

9. The drawing device of claim 4, wherein the sheet that is placed upon the horizontal, planar surface is secured by a plurality of clips, each clip being formed from a resilient material, thereby pressing the sheet onto the horizontal, planar surface.

10. A device for drawing patterns, comprising:

(a) means defining a horizontal planar surface, the planar surface being adapted to support a sheet on which the patterns may be drawn;

(b) a first horizontal member, the first horizontal member having a first end and an oppositely disposed second end, the first horizontal support arm being secured to a stable, planar object by means of clamps, the clamps comprising a threaded shaft, the shaft passing vertically through an orifice near the second end of the first horizontal support arm, the threaded shaft having a top end and a bottom end, an angle bracket, the angle bracket being threadably attached to the shaft and a knob, the knob being attached to the top end of the shaft such that rotation of the knob urges the angle bracket towards the knob, thereby gripping the planar object between the first horizontal support arm and the angle bracket;

(c) a second horizontal member, the second horizontal member having a first end and an oppositely disposed second end;

(d) a control post interconnecting the first end of the first horizontal member and the first end of the second horizontal member such that the first and second horizontal members may pivot freely and independently about the control post in a plane substantially parallel to the horizontal planar surface;

(e) a first horizontal support arm, the first horizontal support arm being rigidly affixed in a stacked, coplanar relationship, to the horizontal planar surface, the first horizontal support arm having an outer end region;

(f) a second horizontal support arm, the second horizontal support arm being rigidly affixed, in a stacked, coplanar relationship, to the horizontal planar surface;

(g) a first pendulum, the first pendulum having a first end, an upper region and a second end, the first pendulum being pivotably attached at the upper region to the first horizontal support arm, the first end of the first pendulum being pivotably attached to the second end of the first horizontal member such that the movement of the first pendulum is transferred to the first horizontal support member, said pendulum further including an upper arm portion, the upper arm portion being formed generally as a hollow rectangular solid having exterior side walls, the exterior side walls being supported by an internal truss, the internal truss being integrally formed within the upper arm portion, a lower arm portion, the lower arm portion being formed generally as a hollow rectangular solid having exterior side walls, the exterior side walls being supported by an internal truss, the internal truss being integrally formed within the lower arm portion, means for attaching the upper arm portion to the lower arm portion, thereby forming a single vertical pendulum support arm, a relatively massive weight, the weight serving to sustain any motion of the pendulum, means for attaching the weight to the vertical pendulum support arm, (h) a second pendulum, the second pendulum having a first end, an upper region and a second end, the second pendulum being pivotably attached at the upper region to the second horizontal support arm, the first end of the second pendulum being pivotably attached to the second end of the second horizontal member such that movement of the second pendulum is transferred to the second horizontal member; and (i) a writing instrument, the writing instrument being rigidly affixed to the first horizontal member such that the writing instrument draws a line along a path determined by a resultant motion generated by movement of the first horizontal member and the second horizontal member.

* * * * *